US007855725B2

(12) United States Patent
Huang

(10) Patent No.: US 7,855,725 B2
(45) Date of Patent: Dec. 21, 2010

(54) METHOD OF CONTROLLING BACKLIGHT MODULE, BACKLIGHT CONTROLLER AND DISPLAY DEVICE USING THE SAME

(75) Inventor: Ling-Hsiu Huang, Tainan County (TW)

(73) Assignee: Himax Technologies Limited, Tainan County (TW)

( * ) Notice: Subject to any disclaimer, the term of this patent is extended or adjusted under 35 U.S.C. 154(b) by 755 days.

(21) Appl. No.: 11/861,892

(22) Filed: Sep. 26, 2007

(65) Prior Publication Data

US 2009/0079768 A1 Mar. 26, 2009

(51) Int. Cl.
*G09G 5/10* (2006.01)

(52) U.S. Cl. ..... 345/691; 345/204

(58) Field of Classification Search ..... 345/204, 345/690–695

See application file for complete search history.

(56) References Cited

U.S. PATENT DOCUMENTS

| | | | | |
|---|---|---|---|---|
| 7,777,714 | B2 * | 8/2010 | Feng et al. | 345/102 |
| 2007/0040935 | A1 * | 2/2007 | Lee et al. | 348/452 |
| 2007/0216828 | A1 * | 9/2007 | Jacobs | 349/64 |
| 2007/0285379 | A1 * | 12/2007 | Jung et al. | 345/102 |
| 2008/0094426 | A1 * | 4/2008 | Kimpe | 345/691 |
| 2009/0174638 | A1 * | 7/2009 | Brown Elliott et al. | 345/88 |

* cited by examiner

*Primary Examiner*—Nitin Patel
(74) *Attorney, Agent, or Firm*—J.C. Patents

(57) ABSTRACT

A method of controlling a backlight module, a backlight controller and a display device using the same are provided herein. The method includes receiving an image having a plurality of regions, wherein the image is displayed by a plurality of color backlights. Next, a feature in a first region of the image and the feature in a second region of the image are analyzed to obtain a spatial weight, wherein the first region and the second region of the image is one of the regions and the second region is neighboring to the first region. Next, the feature in the first region of the image and the feature in the corresponding first region of the preciously received image are analyzed to obtain a temporal weight. One of the color backlights provided to the first region of the image is adjusted according to the spatial weight and the temporal weight.

19 Claims, 5 Drawing Sheets

METHOD OF CONTROLLING BACKLIGHT MODULE, BACKLIGHT CONTROLLER AND DISPLAY DEVICE USING THE SAME

BACKGROUND OF THE INVENTION

1. Field of the Invention

The present invention relates to a method of controlling a backlight module, a backlight controller and a display device using the same, and more particularly, to adjust the backlights according to the image content in spatial domain and in temporal domain.

2. Description of Related Art

With great advance in the techniques of electro-optical and semiconductor devices, flat panel displays, such as liquid crystal displays (LCD), have enjoyed burgeoning development and flourished in recent year. Due to the numerous advantages of the LCD, such as low power consumption, free of radiation, and high space utilization, the LCD has become the main stream in the market. An LCD includes a liquid display panel and a backlight module. The liquid display panel has no capacity of emitting light by itself so that the backlight module is arranged below the liquid display panel to provide the surface light source for the liquid display panel so as to perform the display function.

Generally, a cold cathode fluorescent lamp (CCFL) is disposed on the backlight module and is used for providing a white light as the backlight. Nevertheless, the luminance of the white light depends on the dimension of the CCFL and it is difficult to design a light, thin and small LCD by using the CCFL. Owing to the advantages of the light emitting diodes (LEDs), such as smaller size, lower cost, higher luminance, and higher operational life than the CCFL, the LED gradually replaces the CCFL to provide the backlight.

As for the LED backlight, there are two methods to produce the white light. The first method is to use a white light LED manufactured from a blue LED spread with a fluorescent powder. The white light is produced when the fluorescent powder is excited by the blue light, and the white lights with different color temperatures can be produced by using different fluorescent powders. However, the light-emitting efficiency the white light LED is lower when initially operated and then would cause the luminance of display screen lower. Moreover, the white light often approaches to a blue or a green wave band and does not match the color filters.

The second method is to utilize the red, green and blue LEDs to mix for various color backlights including the white light. Since the wavelengths of the red, green and blue LEDs are close to the transmission wave peaks of the color filters, the color rendering of the mixed white light can be exceed more than 100% of the standards stipulated by National Television Standards Committee (NTSC). Furthermore, the color temperature of the mixed white light can be freely adjusted by regulating the luminance of light emitted from the red, green or blue LEDs.

In general, if equal luminance of each of the backlights from the red, green and blue LEDs is provided to the liquid display panel, the displaying quality of the image changes as the image content. Hence, there are some people previously mentioned that adjusting the backlights according to the local image content can improve the problem of unstable displaying quality, that is, respectively determining the luminance of each of the backlights according to the luminance distribution of each image block. However, adjusting the backlights by the image blocks destroys the spatial continuity of the image, and thereby human eyes perceive non-uniform area between the image blocks to affect the display of color saturation and luminance of the image. Besides, human eyes also perceive flickers when displaying continuous images (or called video) in temporal domain and the flickers cause human eyes get tired easily.

As the above-mentioned description, a low pass filter (LPF) used for adjusting the backlights is needed to smooth the non-uniform area or reduce flickers perceived by human eyes in the images. Since a response of a fixed LPF may be over fast or slow with regard to different image blocks, how to design a proper LPF adapting to the image content for adjusting the backlights becomes an important issue to be researched and discussed.

SUMMARY OF THE INVENTION

Accordingly, the present invention provides a method of controlling a backlight module, a backlight controller and a display device using the same. The controlling method adjusts the backlights according to the feature of the image region in the spatial domain and that in the temporal domain. Therefore, the non-uniform area between the image regions, which are caused by locally adjusting brightness and dimness of the backlights of each image region in the spatial domain, can be improved, and the flickers of displaying the continuous images in temporal domain can be efficiently reduced.

A method of controlling a backlight module is provided in the present invention. First, an image having a plurality of regions is received, wherein the image is displayed by a plurality of color backlights which are provided from the backlight module. Next, a feature in a first region of the image and the feature in a second region of the image are analyzed to obtain a spatial weight, wherein the first region and the second region of the image is one of the regions and the second region is neighboring to the first region. Next the feature in the first region of the image and the feature in the corresponding first region of the preciously received image are analyzed to obtain a temporal weight. One of the color backlights provided to the first region of the image is adjusted according to the spatial weight and the temporal weight.

In one embodiment of the said method for controlling the backlight module, the step of analyzing the feature in the first region of the image and the feature in the second region of the image to obtain the spatial weight comprises to calculate a spatial correlation between the feature in the first region of the image and the feature in the second region of the image, and calculate the spatial weight according to a specific function and the spatial correlation.

In one embodiment of the said method for controlling the backlight module, the step of analyzing the feature in the first region of the image and the feature in the corresponding first region of the image to obtain the temporal weight comprises to calculate a temporal correlation between the feature in the first region of the image and the feature in the corresponding first region of the image, and calculate the temporal weight according to a specific function and the temporal correlation.

A backlight controller comprising an analysis module and a decision module is provided in the present invention for controlling a backlight module to provide a plurality of color backlights. The analysis module receives an image having a plurality of regions for analyzing a feature in a first region of the image and the feature in a second region of the image so as to obtain a spatial weight and analyzing the feature in the first of the image and the feature in the corresponding first region of the previously received image so as to obtain a temporal weight, wherein the first region and the second region is one of the regions and the second region is neighboring to the first region. The decision module is coupled to the analysis module for adjusting one of the color backlights provided to the first region of the image according to the spatial weight and the temporal weight.

A display device comprising a display panel, a backlight module and a backlight controller is provided in the present invention. The display panel is used for displaying an image having a plurality of regions. The backlight module is coupled to the display panel and provides a plurality of color backlights to the display panel so as to display the image. The backlight controller is coupled to the backlight module for analyzing a feature in a first region of the image and feature in a second region of the image and the feature in the corresponding first region of the previously receiver image to adjust one of the color backlights provided to the first region of the image and controlling the backlight module to provide the adjusted color backlight, wherein the first region and the second region is one of the regions and the second region is neighboring to the first region.

The present invention provides a method of controlling a backlight module, a backlight controller and a display device using the same which adjust the color backlights according to the feature of the image region in the spatial domain and that in the temporal domain. Since the content of each image region is different, if the color backlights provided to each image region are only adjusted according to the content of each corresponding image region, human eyes would perceive non-uniform area between the image regions and the flickers in temporal domain when the continuous images are displayed. Therefore, the present invention adjusts the color backlights according to the correlation between the feature of the image region and the feature of the neighboring image region and the correlation between the feature of the image region and the feature of the corresponding region of the previously received image so as to enhance the displaying quality of the image.

In order to make the features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
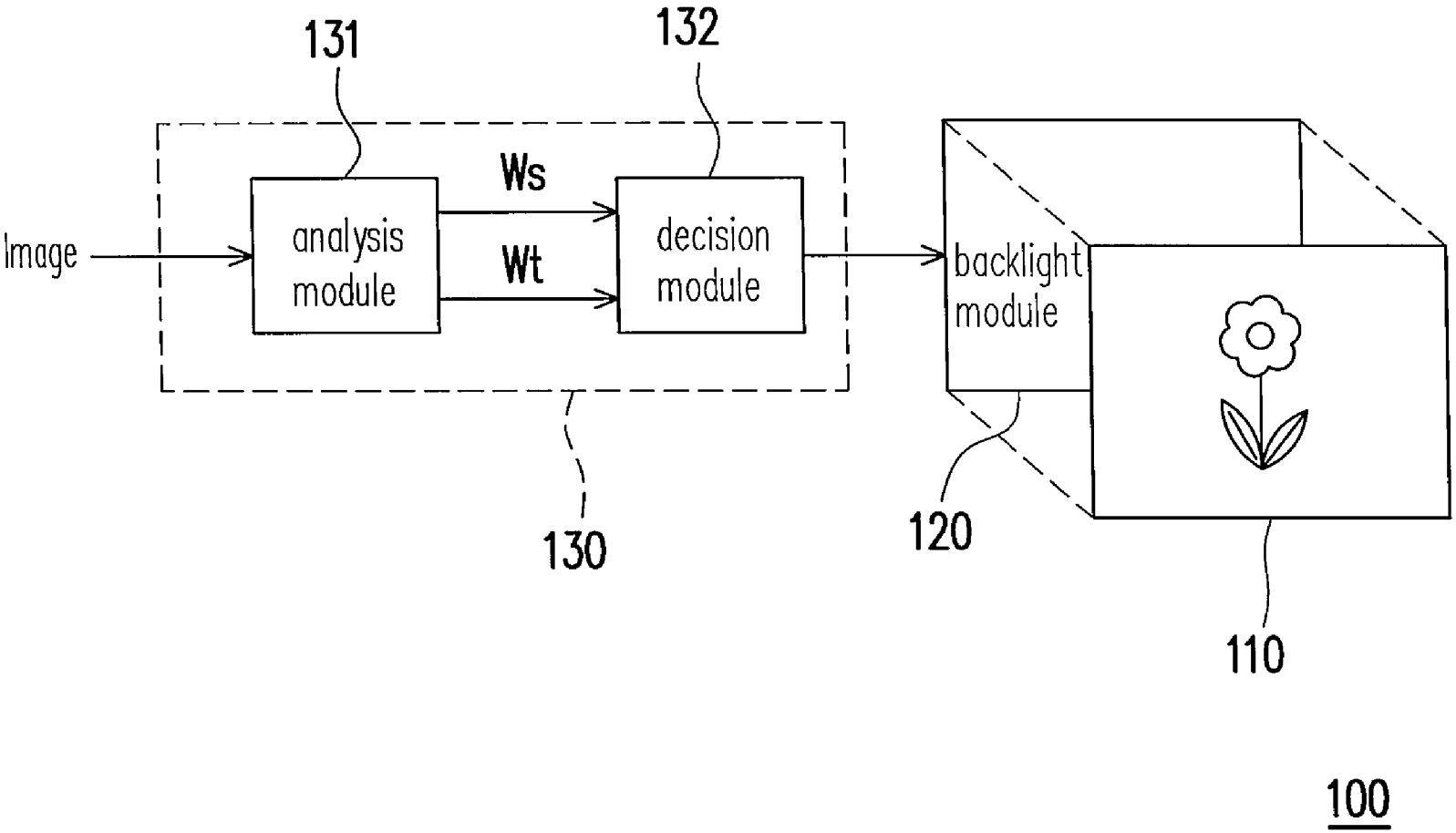
FIG. 1 is a block diagram of a display device according to one embodiment of the present invention.

FIG. 1 is a block diagram of a display device according to one embodiment of the present invention. Referring to FIG. 1, the display device 100 includes a display panel 110, a backlight module 120 and a backlight controller 130, wherein the backlight controller 130 includes an analysis module 131 and a decision module 132. The display panel 110 is used for displaying an image, wherein the image has a plurality of regions. The backlight module 120 is coupled to the display panel 110 and provides a plurality of color backlights, such as red, green, and blue, to the display panel 110 so as to display the image. The backlight controller 130 is coupled to the backlight module 120 for analyzing a feature in a first region of the image and the feature in a second region of the image and the feature in the corresponding first region of the previously received image to adjust one of the color backlights provided to the first region of the image and controlling the backlight module 120 to provide the adjusted color backlight, wherein the first region and the second region is one of the regions and the second region is neighboring to the first region. In the embodiment of the present invention, the feature is one of a luminance average of each image region, an edge distribution of each image region, a color distribution of each image region, a frequency response distribution of each image region and a luminance distribution of each image region.

Figure 2:
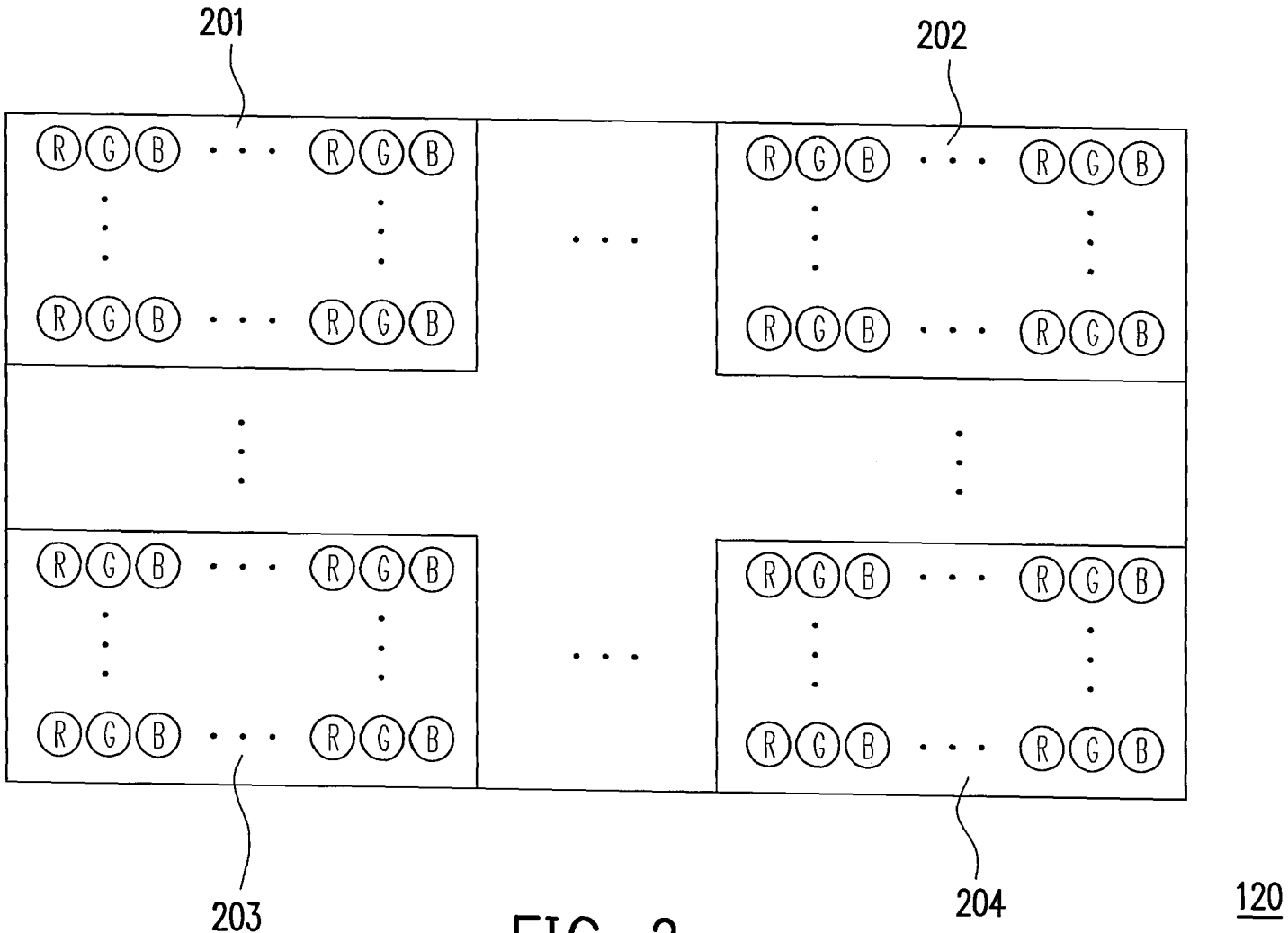
FIG. 2 is a diagram of the backlight module according to one embodiment of the present invention.

FIG. 2 is a diagram of the backlight module 120 according to one embodiment of the present invention. In the embodiment, referring to FIG. 2, a red (R), a green (G), and a blue (B) light emitting diodes (LEDs) are supposed to be disposed on one of the display pixels in the backlight module 120 so as to provide the said color backlights. Since the image has a plurality of regions, such as m×n regions, the backlight module 120 can also be separated into the said regions, such as regions 201-204 (only four regions are shown for description herein). To enhance the displaying quality of the image, it is important to control the luminance of the color backlights, that is, adjusting brightness and dimness of the color backlights.

For the convenience of description, the feature in the first region of the image, the feature in the second region of the image and the feature in the corresponding first region of the previously received image are respectively named f(i,j), f(x, y) and f_pre(i,j), wherein (i,j) and (x,y) indicate the coordinates of the regions. With regard to display the image, the luminance of the red, green, and blue backlights provided to the first region are respectively named $Ls(i,j)__R$, $Ls(i,j)__G$, and $Ls(i,j)__B$. Besides, with regard to display the previously received image, the luminance of the red, green, and blue backlights provided to the first region are respectively named $Ls_pre(i,j)__R$, $Ls_pre(i,j)__G$, and $Ls_pre(i,j)__B$.

Figure 3A:
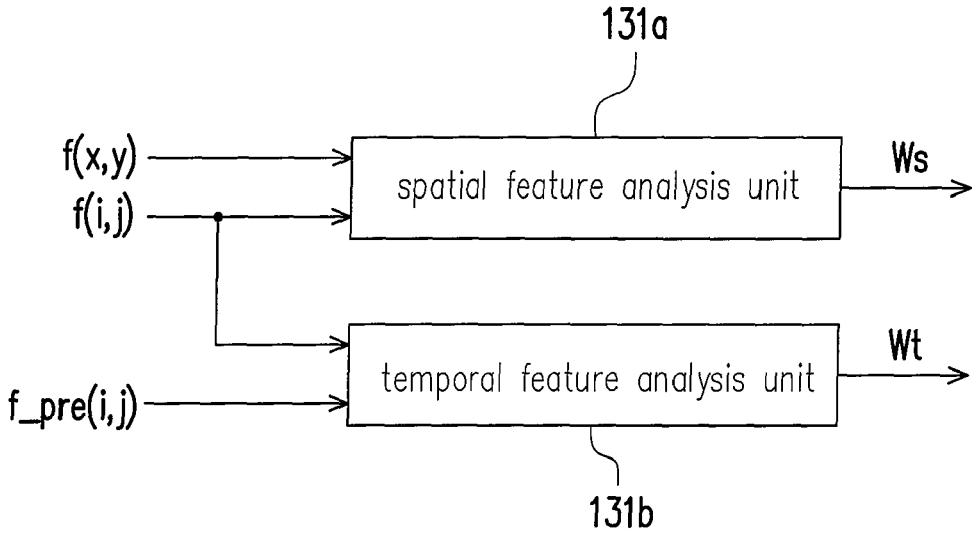
FIG. 3A is a block diagram of the analysis module in FIG. 1 according to one embodiment of the present invention.

The following description is the detail operation of each module. FIG. 3A is a block diagram of the analysis module 131 in FIG. 1 according to one embodiment of the present invention. Referring to FIG. 3A, the analysis module 131 includes a spatial feature analysis unit 131*a* and a temporal feature analysis unit 131*b*. The spatial feature analysis unit 131*a* is used for calculating a spatial correlation Cs between the feature in the first region of the image and the feature in the second region of the image, that is, a spatial correlation Cs between the feature f(i,j) and the feature f(x,y) and calculating a spatial weight Ws according to a specific function and the spatial correlation Cs. The temporal feature analysis unit 131*b* is used for calculating a temporal correlation Ct between the feature in the first region of the image and the feature in the corresponding first region of the previously received image, that is, the temporal correlation Ct between the feature f(i,j) and the feature f_pre(i,j), and calculating a temporal weight Wt according the specific function and the temporal correlation Cy.

Figure 3B:
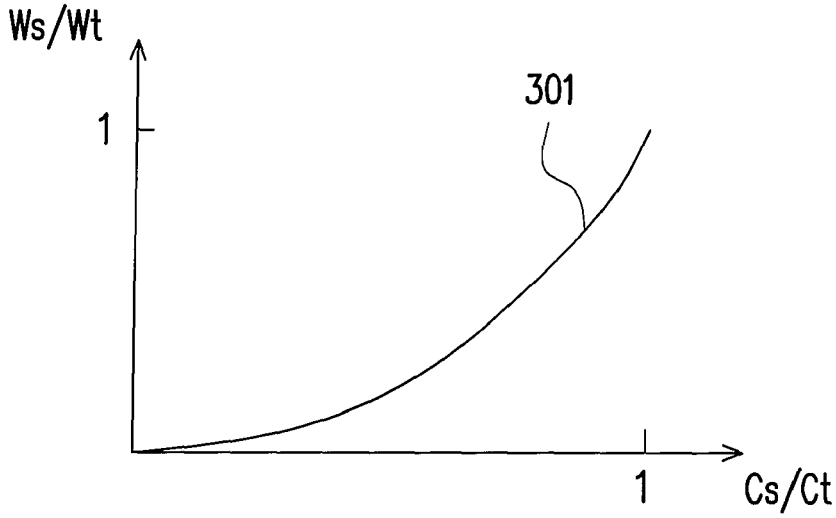
FIG. 3B is a curve diagram of the specific function according to one embodiment of the present invention.

FIG. 3B is a curve diagram of the specific function according to one embodiment of the present invention. Referring to FIG. 3B, the curve 301 of the specific function is obtained by experimentations. The curve 301 of the specific function represents that the higher the spatial correlation Cs (or the temporal correlation Ct) is, the higher the spatial weight Ws (or the temporal weight Wt) is, that is, the higher the spatial correlation Cs is, the more the color backlights provided to the second region of the image need to be referred for adjusting the color backlights provided to the first region of the image and the higher the temporal correlation Ct is, the more the color backlights provided to the corresponding first region of the previously received image need to be referred for adjusting the color backlights provided to the first region of the image.

Figure 4A:
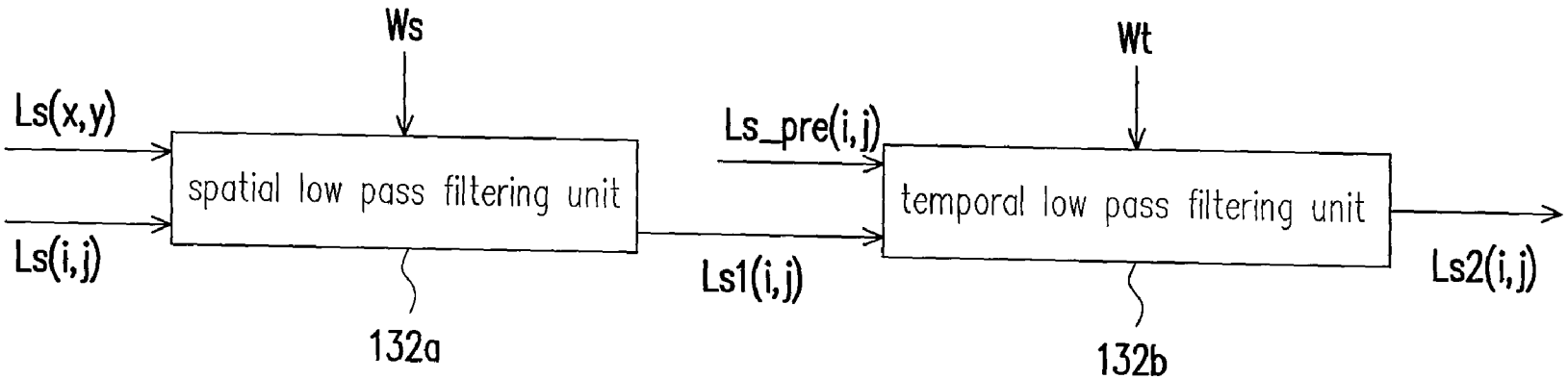
FIG. 4A is a block diagram of the decision module in FIG. 1 according to one embodiment of the present invention.

FIG. 4A is a block diagram of the decision module 132 in FIG. 1 according to one embodiment of the present invention. Referring to FIG. 4A, the decision module 132 includes a spatial low pass filtering unit 132*a* and a temporal low pass filtering unit 132*b*. The spatial low pass filtering unit 132*a* is used for calculating a first weight sum Ls1(i,j) of one of the color backlights Ls(i,j) provided to the first region of the image and the one of the color backlights Ls(x,y) provided to the second region of the image, wherein the first weight sum Ls1(i,j) relates to the spatial weight Ws. The temporal low pass filtering unit 132*b* is used for calculating a second weight sum Ls2(i,j) of the first weight sum Ls1(i,j) and the one of the color backlights Ls_pre(i,j) provided to the corresponding first region of the previously received image as the adjusted color backlight, wherein the second weight sum Ls2(i,j) relates to the temporal weight Wt.

For example, one of the color backlight, such as red backlight $Ls(i,j)_{_R}$, provided to the first region is adjusted through the spatial low pass filtering unit 132*a* and the first weight sum $Ls1(i,j)_{_R}$ equaling a summation of $Ls(i,j)_{_R}\times(1-Ws)+Ls(x,y)_{_R}\times Ws$, which x is from (i−1) to (i+1) and y is from (j−1) to (j+1), is taken as the adjusted red backlight. Next, the one of the backlight, such as the said adjusted red backlight $Ls1(i,j)_{_R}$, provided to the first region is also adjusted through the temporal low pass filtering unit 132*b* and the second weight sum $Ls2(i,j)_{_R}$ equaling $Ls1(i,j)_{_R}\times(1-Wt)+Ls_pre(i,j)_{_R}\times Wt$ is taken as the newest adjusted red backlight. Therefore, the other color backlights are adjusted by analogizing, that is, the adjusted green backlight $Ls2(i,j)_{_G}$ equals $Ls1(i,j)_{_G}\times(1-Wt)+Ls_pre(i,j)_{_G}\times Wt$ and the adjusted blue backlight $Ls2(i,j)_{_B}$ equals $Ls1(i,j)_{_B}\times(1-Wt)+Ls_pre(i,j)_{_B}\times Wt$, wherein $Ls1(i,j)_{_G}$ equals a summation of $Ls(i,j)_{_G}\times(1-Ws)+Ls(x,y)_{_G}\times Ws$, which x is from (i−1) to (i+1) and y is from (j−1) to (j+1), and $Ls1(i,j)_{_B}$ equals a summation of $Ls(i,j)_{_B}\times(1-Ws)+Ls(x,y)_{_B}\times Ws$, which x is from (i−1) to (i+1) and y is from (j−1) to (j+1).

Figure 4B:
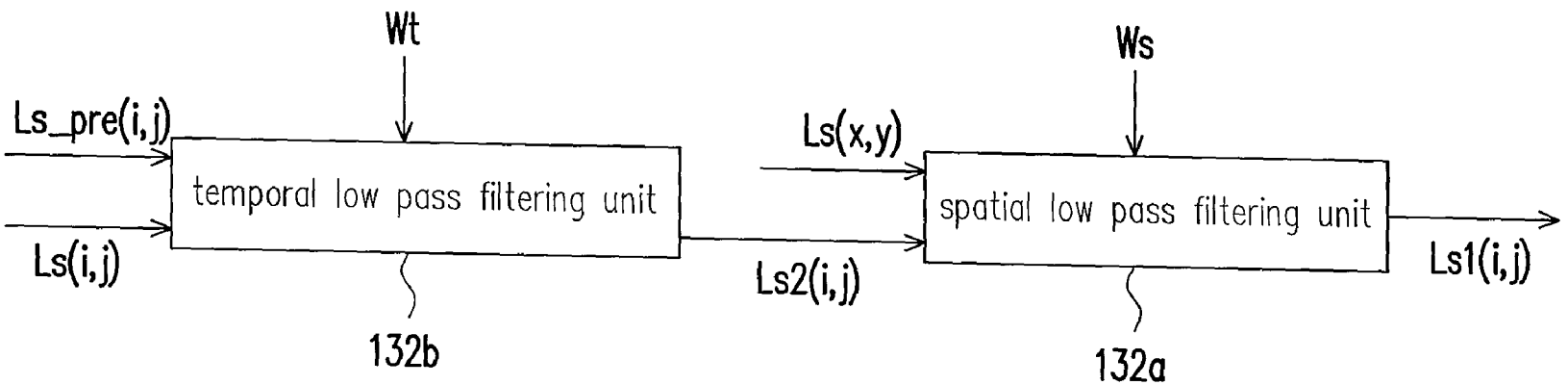
FIG. 4B is a block diagram of the decision module in FIG. 1 according to another embodiment of the present invention.

It is noted that the order of adjusting the color backlights through the spatial low pass filtering unit 132*a* and through the temporal low pass filtering unit 132*b* should not be limit. FIG. 4B is a block diagram of the decision module 132 in FIG. 1 according to another embodiment of the present invention. Referring to FIG. 4B, the temporal low pass filtering unit 132*b* calculates the second weight sum Ls2(i,j) of one of the color backlights Ls(i,j) provided to the first region of the image and the one of the color backlight Ls_pre(i,j) provided to the corresponding first region of the previously received image, wherein the second weight sum Ls2(i,j) relates to the temporal weight Wt. Next, the spatial low pass filtering unit 132*a* calculates the first weight sum Ls1(i,j) of the second weight sum Ls2(i,j) and the one of the color backlights Ls(x, y) provided to the second region of the image, wherein the first weight Ls1(i,j) relates to the spatial weight Ws.

For example, one of the color backlight, such as red backlight $Ls(i,j)_{_R}$, provided to the first region is adjusted through the temporal low pass filtering unit 132*b* and the second weight sum $Ls2(i,j)_{_R}$ equaling $Ls(i,j)_{_R}\times(131\ Wt)+Ls_pre(i,j)_{_R}\times Wt$, is taken as the adjusted red backlight. Next, the one of the backlight, such as the said adjusted red backlight $Ls2(i,j)_{_R}$, provided to the first region is also adjusted through the spatial low pass filtering unit 132*a* and the first weight sum $Ls1(i,j)_{_R}$ equaling a summation of $Ls2(i,j)_{_R}\times(1-Ws)+Ls(x,y)_{_R}\times Ws$, which x is from (i−1) to (i+1) and y is from (j−1) to (j+1), is taken as the newest adjusted red backlight. Therefore, the other color backlights are adjusted by analogizing, that is, the adjusted green backlight $Ls1(i,j)_{_G}$ equals a summation of $Ls2(i,j)_{_G}\times(1-Ws)+Ls(x,y)_{_G}\times Ws$, which x is from (i−1) to (i+1) and y is from (j−1) to (j+1), and the adjusted blue backlight $Ls1(i,j)_{_B}$ equals a summation of $Ls2(i,j)_{_B}\times(1-Ws)+Ls(x,y)_{_B}\times Ws$, which x is from (i−1) to (i+1) and y is from (j−1) to (j+1), wherein $Ls2(i,j)_{_G}$ equals $Ls(i,j)_{_G}\times(1-Wt)+Ls_pre(i,j)_{_G}\times Wt$ and $Ls2(i,j)_{_B}$ equals $Ls(i,j)_{_B}\times(1-Wt)+Ls_pre(i,j)_{_B}\times Wt$.

Figure 5:
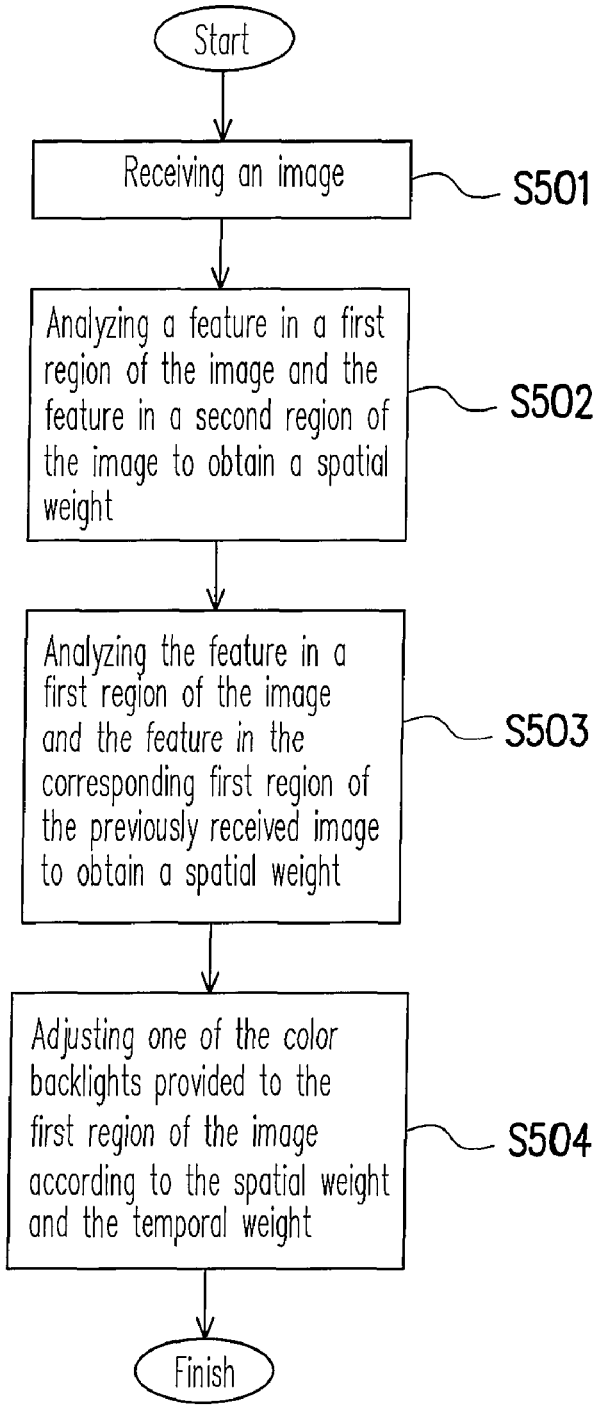
FIG. 5 is a flow chart of a method of controlling the backlight module according to one embodiment of the present invention.

According to the embodiments described above, the steps of the following method could be generalized. FIG. 5 is a flow chart of a method of controlling the backlight module 120 according to one embodiment of the present invention. First, in step S501, an image having a plurality of regions is received. Next, a feature in a first region of the image and the feature in a second region of the image are analyzed to obtain a spatial weight in step S502, wherein the first region and the second region is one of the regions and the second region is neighboring to the first region. In addition, the feature in the first region of the image and the feature in the corresponding first region of the previously received image are analyzed to obtain a temporal weight in step S503. In step S504, one of the color backlights provided to the first region of the image is adjusted according to the spatial weight Ws and the temporal weight Wt.

In summary, the embodiment of the present invention adjusts the color backlights provided to the image region according to the feature of the image region in the spatial domain and in the temporal domain, wherein the feature is one of a luminance average, an edge distribution, a color distribution, a frequency response distribution and a luminance distribution. In the embodiment of the present invention, a specific function and a spatial correlation between the feature of the image region and the feature of the neighboring image region are utilized to obtain a spatial weight. Also, the specific function and a temporal correlation between the feature of the image region and the feature of the previous image region are utilized to obtain a temporal weight. By referring the specific function as shown in FIG. 3B, the spatial weight (or the temporal weight) gets higher when the spatial correlation (or the temporal correlation) is higher. Namely, the higher the spatial correlation is, the more the feature of the neighboring image region needs to be referred and the higher the temporal correlation is, the more the feature of the previous image region needs to be referred.

The embodiment of the present invention utilized the spatial weight and the temporal weight to dynamically adjust the parameters of the low pass filter, such as the spatial low pass filtering unit 132*a* and the temporal low pass filtering 132*b* unit in FIG. 4A and FIG. 4B, so as to adjust the color backlights provided to the image region. Therefore, by referring the features in spatial domain and in temporal domain, the non-uniform area appearing between the regions can be smoothed and the flickers that cause human eyes get tired easily also can be reduced.

Though the present invention has been disclosed above by the preferred embodiments, they are not intended to limit the present invention. Anybody skilled in the art can make some modifications and variations without departing from the spirit and scope of the present invention. Therefore, the protecting range of the present invention falls in the appended claims.

What is claimed is:

1. A method of controlling a backlight module, comprising:

receiving an image, wherein the image having a plurality of regions is displayed by a plurality of color backlights provided from a backlight module;

analyzing a feature in a first region of the image and the feature in a second region of the image to obtain a spatial weight, wherein the first region and the second region is one of the regions and the second region is neighboring to the first region;

analyzing the feature in the first region of the image and the feature in the corresponding first region of the previously received image to obtain a temporal weight; and adjusting one of the color backlights provided to the first region of the image according to the spatial weight and the temporal weight.

2. The method of controlling the backlight module as claimed in claim 1, wherein the step of analyzing the feature in the first region of the image and the feature in the second region of the image to obtain the spatial weight comprises:

calculating a spatial correlation between the feature in the first region of the image and the feature in the second region of the image; and calculating the spatial weight according to a specific function and the spatial correlation.

3. The method of controlling the backlight module as claimed in claim 1, wherein the step of analyzing the feature in the first region of the image and the feature in the corresponding first region of the previously received image to obtain the temporal weight comprises:

calculating a temporal correlation between the feature in the first region of the image and the feature in the corresponding first region of the previously received image; and calculating the temporal weight according to a specific function and the temporal correlation.

4. The method of controlling the backlight module as claimed in claim 1, wherein the step of adjusting one of the color backlights provided to the first region of the image according to the spatial weight and the temporal weight comprises:

calculating a first weight sum of the one of the color backlights provided to the first region of the image and the one of the color backlights provided to the second region of the image to be the adjusted color backlight, wherein the first weight sum relates to the spatial weight.

5. The method of controlling the backlight module as claimed in claim 4, wherein the first weight sum L1 equals to $Lpc\times(1-Ws)+Ls\times Ws$, and Lpc is the one of the color backlights provided to the first region of the image, Ls is the one of the color backlights provided to the second region of the image and Ws is the spatial weight.

6. The method of controlling the backlight module as claimed in claim 1, wherein the step of adjusting one of the color backlights provided to the first region of the image according to the spatial weight and the temporal weight comprises:

calculating a second weight sum of the one of the color backlights provided to the first region of the image and the one of the color backlights provided to the corresponding first region of the previously received image to be the adjusted color backlight, wherein the second weight sum relates to the temporal weight.

7. The method of controlling the backlight module as claimed in claim 6, wherein the second weight sum L2 equals to $Lpc\times(1-Wt)+Lt\times Wt$, and Lpc is the one of the color backlights provided to the first region of the image, Lt is the one of the color backlights provided to the corresponding first region of the previously received image and Wt is the temporal weight.

8. The method of controlling the backlight module as claimed in claim 1, wherein the feature is one of a luminance average, an edge distribution, a color distribution, a frequency response distribution and a luminance distribution.

9. A backlight controller for controlling a backlight module to provide a plurality of color backlights, comprising:

an analysis module, receiving an image having a plurality of regions, for analyzing a feature in a first region of the image and the feature in a second region of the image to obtain a spatial weight, and analyzing the feature in the first region of the image and the feature in the corresponding first region of the previously received image to obtain a temporal weight, wherein the first region and the second region is one of the regions and the second region is neighboring to the first region; and a decision module, coupled to the analysis module, for adjusting one of the color backlights provided to the first region of the image according to the spatial weight and the temporal weight.

10. The backlight controller as claimed in claim 9, wherein the analysis module further comprises:

a spatial feature analysis unit, for calculating a spatial correlation between the feature in the first region of the image and the feature in the second region of the image and calculating the spatial weight according to a specific function and the spatial correlation; and a temporal feature analysis unit, for calculating a temporal correlation between the feature in the first region of the image and the feature in the corresponding first region of the previously received image and calculating the temporal weight according to the specific function and the temporal correlation.

11. The backlight controller as claimed in claim 9, wherein the decision module further comprises:

a spatial low pass filtering unit, for calculating a first weight sum of the one of the color backlights provided to the first region of the image and the one of the color backlights provided to the second region of the image to be the adjusted color backlight, wherein the first weight sum relates to the spatial weight.

12. The backlight controller as claimed in claim 9, wherein the decision module further comprises:

a temporal low pass filtering unit, for calculating a second weight sum of the one of the color backlights provided to the first region of the image and the one of the color backlights provided to the corresponding first region of the previously received image to be the adjusted color backlight, wherein the second weight sum relates to the temporal weight.

13. The backlight controller as claimed in claim 9, wherein the feature is one of a luminance average, an edge distribution, a color distribution, a frequency response distribution and a luminance distribution.

14. A display device, comprising:

a display panel, for displaying an image, wherein the image has a plurality of regions;

a backlight module, coupled to the display panel, for providing a plurality of color backlights to the display panel to display the image; and a backlight controller, coupled to the backlight module for analyzing a feature in a first region of the image and the feature in a second region of the image and the feature in the corresponding first region of the previously received image to adjust one of the color backlights provided to the first region of the image and controlling the backlight module to provide the adjusted color backlight, wherein the first region and the second region is one of the regions and the second region is neighboring to the first region.

15. The display device as claimed in claim 14, wherein the backlight controller comprises:

an analysis module, receiving an image, for analyzing the feature in the first region of the image and the feature in the second region of the image to obtain a spatial weight, and analyzing the feature in the first region of the image and the feature in the corresponding first region of the previously received image to obtain a temporal weight; and a decision module, coupled to the analysis module, for adjusting the one of the color backlights provided to the first region of the image according to the spatial weight and the temporal weight.

16. The display device as claimed in claim 15, wherein the analysis module further comprises:

a spatial feature analysis unit, for calculating a spatial correlation between the feature in the first region of the image and the feature in the second region of the image and calculating the spatial weight according to a specific function and the spatial correlation; and a temporal feature analysis unit, for calculating a temporal correlation between the feature in the first region of the image and the feature in the corresponding first region of the previously received image and calculating the temporal weight according to the specific function and the temporal correlation.

17. The display device as claimed in claim 15, wherein the decision module further comprises:

a spatial low pass filtering unit, for calculating a first weight sum of the one of the color backlights provided to the first region and the one of the color backlights provided to the second region of the image to be the adjusted color backlight, wherein the first weight sum relates to the spatial weight.

18. The display device as claimed in claim 15, wherein the decision module further comprises:

a temporal low pass filtering unit, for calculating a second weight sum of the one of the color backlights provided to the first region of the image and the one of the color backlights provided to the corresponding first region of the previously received image to be the adjusted color backlight, wherein the second weight sum relates to the temporal weight.

19. The display device as claimed in claim 14, wherein the feature is one of a luminance average, an edge distribution, a color distribution, a frequency response distribution and a luminance distribution.

* * * * *